United States Patent [19]

August, Sr. et al.

[11] Patent Number: 4,954,813

[45] Date of Patent: Sep. 4, 1990

[54] PORTABLE WARNING DEVICE

[75] Inventors: Alfred A. August, Sr., Concord; Anthony M. Jackson, San Jose, both of Calif.

[73] Assignee: Safety by Design, Inc., Santa Clara, Calif.

[21] Appl. No.: 391,086

[22] Filed: Aug. 9, 1989

[51] Int. Cl.[5] ..... G08B 13/14

[52] U.S. Cl. ..... 340/571; 340/573; 340/693

[58] Field of Search ..... 340/573, 326, 571, 815.17, 340/693; 364/516; 250/342, 221; 362/802; 40/902, 463, 465; 84/464 R

[56] References Cited

U.S. PATENT DOCUMENTS

| | | | |
|---|---|---|---|
| 3,594,760 | 7/1971 | Haker | 340/326 X |
| 3,916,401 | 10/1975 | Freeman | 340/326 X |
| 4,222,188 | 9/1980 | Tarrant et al. | 40/902 X |
| 4,346,427 | 8/1982 | Blissett et al. | 340/573 X |
| 4,358,754 | 11/1982 | Young et al. | 340/815.17 |
| 4,709,330 | 11/1987 | Yokoi et al. | 340/573 X |
| 4,841,285 | 6/1989 | Laut | 340/571 |
| 4,853,678 | 8/1989 | Bishop, Jr. et al. | 340/573 |

FOREIGN PATENT DOCUMENTS

| | | | |
|---|---|---|---|
| 3334554 | 4/1985 | Fed. Rep. of Germany | 362/802 |

*Primary Examiner*—Joseph A. Orsino
*Assistant Examiner*—Thomas J. Mullen, Jr.
*Attorney, Agent, or Firm*—Jack C. Munro

[57] ABSTRACT

A portable warning device in the form of a stanchion which is to be readily movable and locatable at any desired location. The portable warning device includes a movable light assembly to attract attention to the warning device to any human being which passes nearby. Once the human being reaches within a certain number of feet in distance from the warning device, a prerecorded message is emitted to audibly warn the human being. Any unauthorized removal of the warning device will immediately activate an antitheft alarm which will produce some form of an audible signal calling attention to the fact that thievery of the device is occurring.

5 Claims, 3 Drawing Sheets

PORTABLE WARNING DEVICE

BACKGROUND OF THE INVENTION

The field of this invention relates to warning device and more particularly to a warning device in the form of a portable stanchion which can be individually programmed by the particular user for a particular warning message.

The use of warning devices of different types have long been known. A simple form of warning device is a brightly colored cone which is commonly used in conjunction with roadways to warn human beings in motor vehicles that they are approaching a potentially dangerous situation. In the past, such brightly colored cones have also been used to warn human beings in commercial establishments of wet floors, open elevator shafts, men at work, and other potentially hazardous conditions.

However, such a passive warning device may not impart its message to certain individuals. For example, a blind person may not perceive that there is a dangerous situation. Also, it has been known that certain individuals may be preoccupied and just may not see the danger. The only sense a passive warning device is appealing to is the sense of sight. If the warning device could appeal also to the sense of hearing, the use of the warning device could be greatly expanded. Typical expanded usage could be to warn an individual of a work area, a wet paint area, a potentially overhead condition, and possibly a piece of equipment being out of order.

A warning device could also be used to be informative. Informative devices would be most helpful having to do with pedestrian control, for promotion of products or sevices, warning of no smoking areas, informing individuals of certain security restrictions as well as instructing the public such as by giving directions.

In the past, such warning devices may frequently utilize some form of trigger device so when stepped on or pass over a certain beam, that the warning device would be activated. The inherent problem with these prior art devices is that such were not self-contained. Other than the warning device itself, it was necessary to utilize a separate triggering mechanism that has to be connected as by a wire to the warning device. Not only did this require additional equipment, but many times the use of the separate trigger actuation device would prevent usage of the warning device within certain areas.

SUMMARY OF THE INVENTION

The subject of the present invention is discussed n general terms as a warning device and it is considered to be within the scope of this invention that a device which informs, called a director, is also within the category of a warning device. The informative type of warning device takes the form of an upright stanchion in which is included battery powered electronic circuitry which when operating will cause a sequential flashing of a plurality of lights to attract attention to the device. Once an individual reaches within a certain distance, such as ten to twelve feet, a sensor circuit is activated which causes a prerecorded message to be transmitted. This prerecorded message can be informative, directive, educational, or whatever, according to the desires of the user of the device. When the device is used to warn an individual of a potentially dangerous condition, the prerecorded message will generally strongly instruct the individual to "stay away". A strobe light is to be used in conjunction with the warning device when it is used to inform an individual of a dangeous condition. Both devices include an antitheft circuit which will emit a loud noise, such as in the form of a siren, if unauthorized removal of the device occurs. When the warning device is used to be informative, only a single sensor circuit is incorporated. Also, this director type of warning device is to include a sign display area. When the warning device is used to warn one of a dangerous condition, there may be included two separate sensor circuits to have the device be sensitive to the area almost entirely around the device rather than just the area in front of the device.

DETAILED DESCRIPTION OF THE SHOWN EMBODIMENTS

Figure 1:
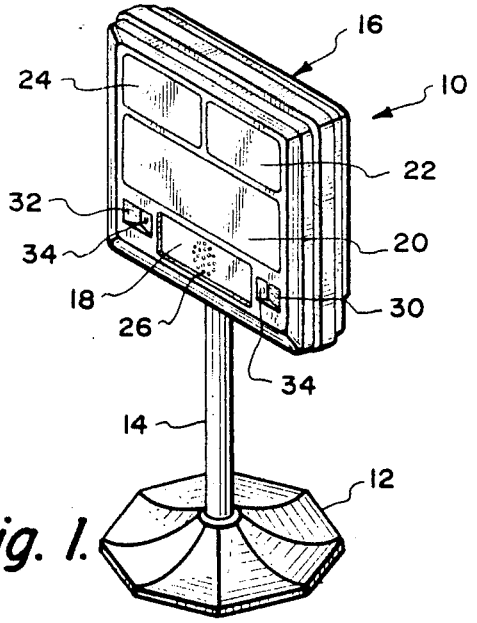
FIG. 1 is a frontal isometric view of the director or informative type of warning device of this invention.
Figure 2:
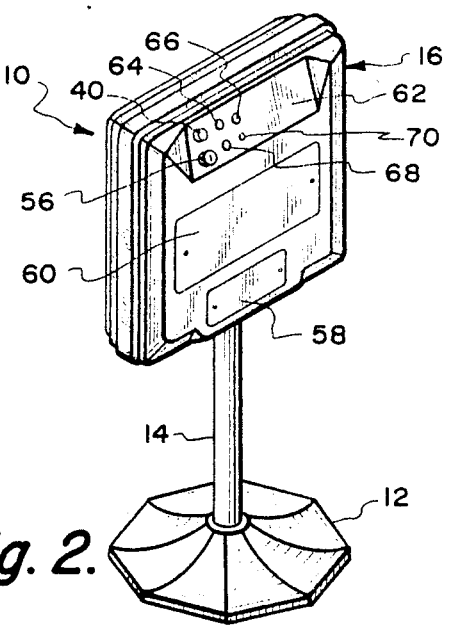
FIG. 2 is an isometric view of the rear portion of the director of FIG. 1.

Referring particularly to the drawings there is shown in FIG. 1 a front isometric view of one embodiment of this invention which is known as the director 10. The director 10 includes a pedestal base 12 on which is mounted a pedestal 14. Fixedly mounted on the upper end of the pedestal 14 is a housing 16. The housing 16 includes front surface which is divided into a front panel 18, an indicator panel 20 and a pair of message panels 22 and 24. It is within the scope of this invention that the indicator panel 20 and message panels 22 and 24 could be all combined into a single enlarged panel (not shown) if such is desired.

The front panel 18 inclues a mass of holes 26. It is the purpose of the holes 26 to permit substantially unobstructed emission of sound from a speaker 28 which is mounted within the housing 16. Located at each end of the front panel 18 and formed within the housing 16 are indentations 30 and 32. Within each indentation 30 and 32 is located a sensor 34. Within the schematic of FIG. 5, there is only one sensor 34 being shown. However, if it is desired, two sensors could be utilized, one each located within an indentation 30 and 32.

It is the function of the sensors 34 to detect heat and generate electrical responses upon detecting of heat. The sensor 34 are known as pyroelectric sensors. Generally, motion within about ten feet forward of the front surface of the housing 16 will cause a voltage change to occur within the sensor 34. It is desirable that sensor 34 detect heat within about one hundred eighty degrees which covers the entire angular area forward of the front panel 18.

Mounted within the housing 16 and located directly adjacent the indicator panel 20 is a light bulb 36. In actual practice, there may be utilized two or more in number of light bulbs 36 with all the light bulbs 36 being associated only with the indicator panel. Where the director 10 incorporates a single enlarged indicator panel eliminating in essence the separate panels 20, 22 and 24, the bulbs 36 will be the bulbs that are located nearest the front panel 18.

Associated with the message panel 22 is a light bulb 38. A separate light bulb 38 is associated with the message panel 24. Both the light bulbs 38 are to be operated simultaneously as well as the light bulbs 36 also being operated simultaneously. In other words, the bulbs 38 are electrically connected in series as well as the bulbs 36 being electrically connected in series. It is to be understood that also the bulbs 36 and 38 may be electrically connected in series by manually selecting such through a selector switch 40. Also, selector switch 40 could be moved to a different position which causes bulbs 36 and 38 to be operated by a flip-flop 42.

Flip-flop 42 includes a timing circuit in the form of resistor 44 and a capacitor 46. Between the flip-flop 42 and the light bulb 36 is located a resistor 48. A similar resistor 50 is located between the flip-flop 42 and the bulb 38. The bulbs 36 and 38 are to be driven electrically by voltage Vcc. Voltage Vcc is generated from a battery 52 through a voltage regulator 54. Voltage regulator 54 is activated when switch 56 is turned from the "off" position to the "on" position. Normally, the switch 56 will be in the form of a key operated switch.

With the selector switch 40 in the position not connecting in series the bulbs 36 and 38, the flip-flop 42 will cause bulb 36 to be activated for a certain period of time, such as one second. The flip-flop 42 will then turn off the bulb 36 and activate the bulb 38 for the same period of time. This procedure is repeated continuously for as long as the selector switch 40 is in that position and the switch 56 is in the "on" position. The purpose of generating a flashing light arrangement is to encourage visual observance of the front surface of the housing 16. It would be common to include within the indicator panel a form of indicia such as words or drawings. Additional words or drawings may be included within panels 22 and 24.

The reason the panels 20, 22 and 24 may be divided is so as to permit the including of separate messages on the front surface of the housing 16. If only a single enlarged panel is utilized replacing the separate panels 20, 22 and 24, it may be difficult to make it clear that there are in essence separate messages being utilized since a single panel has a tendency to give the appearance of a single message.

Within the back surface of the housing 16 there is located a battery panel 58, an access panel 60 and an instrumentation panel 62. The battery panel can be removed to permit replacement of the battery 52. The access panel 60 provides access into the electronics incorporated with the housing 16. The instrumentation panel 62 has mounted in conjunction therewith a plurality of different devices which are utilized to operate the director 10 of this invention. Typical devices would be the switch 40, a microphone 64, a buttom 66 which is to be operated when it is desired to record a message within the director 10 of this invention. Also mounted within the instrumentation panel 62 is the key operated switch 56. It is noted that within FIG. 6 that the key operated switch 56 is shown as two separate switches. However, in actual practice these two separate switches will be included as one switch having three positions permitting the switch to be moved from an "off" position to a "record" position and to an "on" position.

There may also be included within the panel 62 a low battery indicator light 68 and a charging jack 70. The purpose of the charging jack 70 is to permit connection to an outside source of electrical energy which is to be utilized to recharge the battery 52. Such a charging jack 70 is not shown within the electrical schematic since such is deemed to be conventional. Also, similarly, the low battery indicator 68 is deemed to be conventional and is not included within the circuitry of FIG. 5, 6 and 7.

Figure 3:
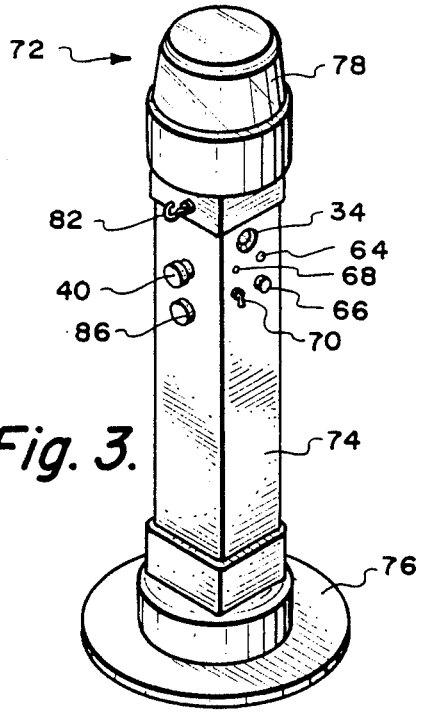
FIG. 3 is a frontal isometric view of the warning device of this invention that is utilized to warn an individual of a dangerous condition.
Figure 4:
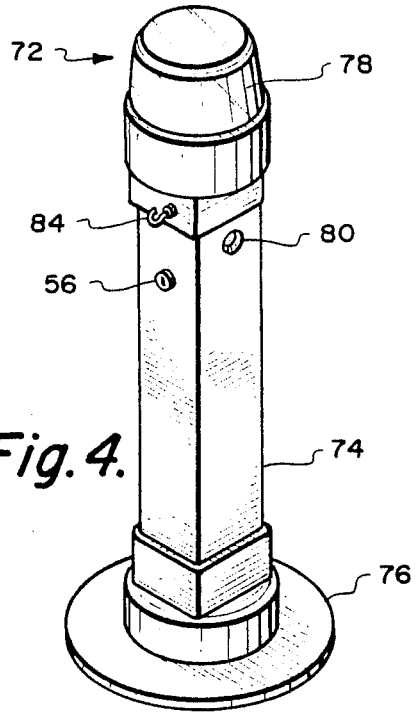
FIG. 4 is a rear directional isometric view of the upper portion of the warning device of FIG. 3.

Referring particularly to FIG. 3 of the drawings, there is shown a second embodiment 72 of this invention. Generally, the purpose of the second embodiment 72 is to function as a warning device with generally the director 10 to be utilized more as a directional device. However, it is to be understood to be within the scope of this inventioon that the director 10 could also be used as a warning device.

Figure 5:
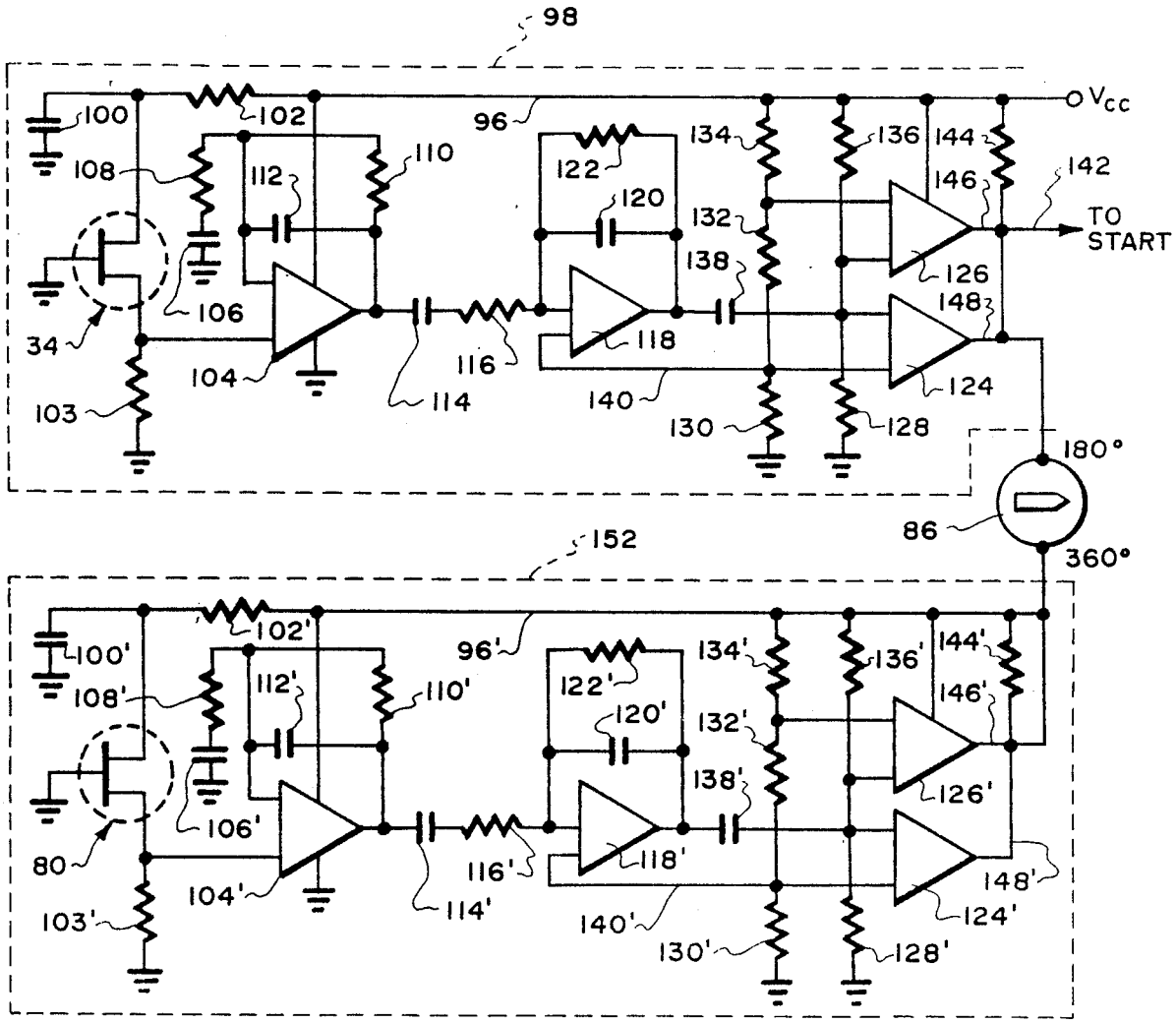
FIG. 5, 6 and 7, when combined, constitute the complete electrical schematic that is to be utilized in conjunction with the warning devices of the present invention.
Figure 7:
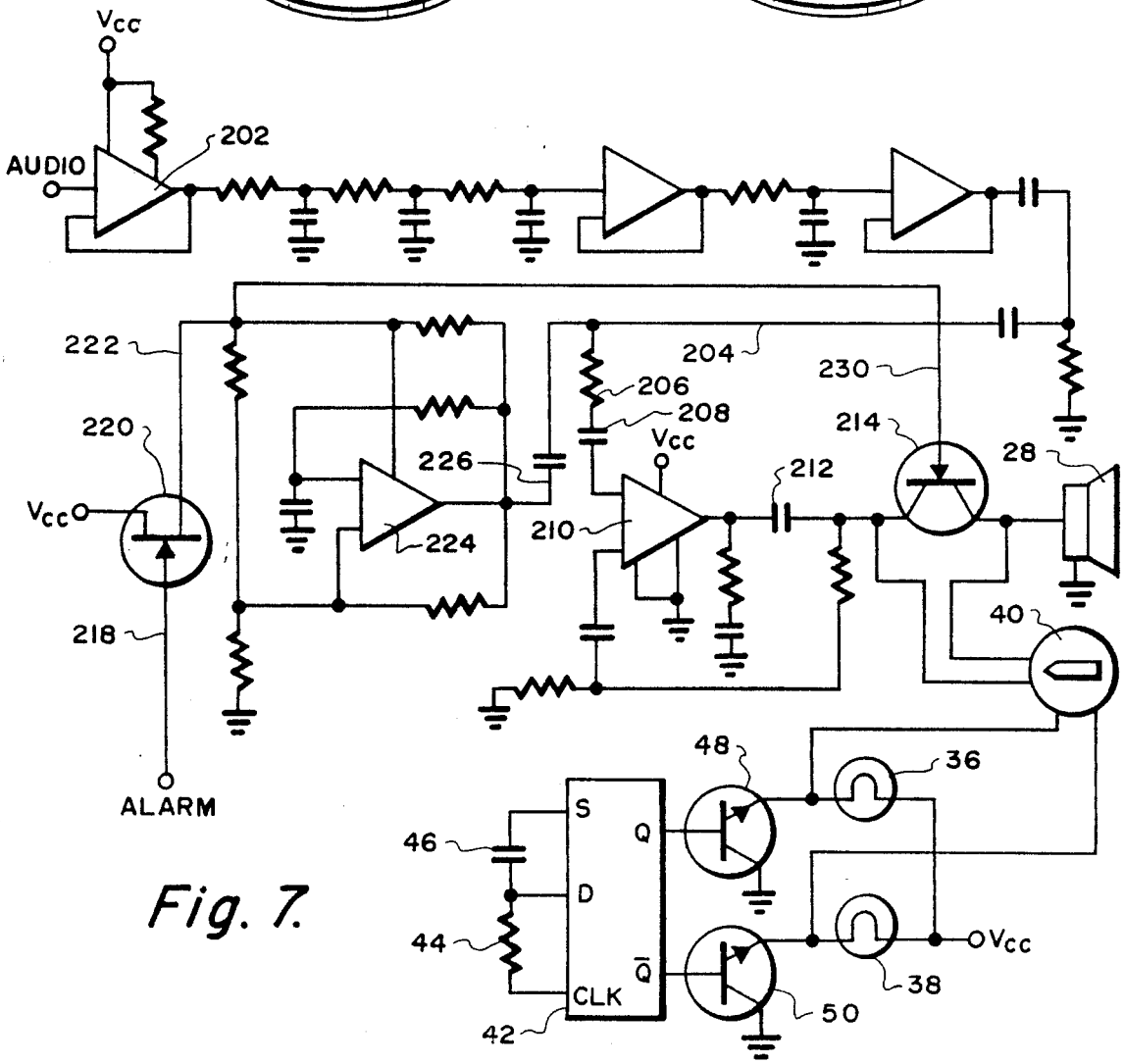
Figure 6:
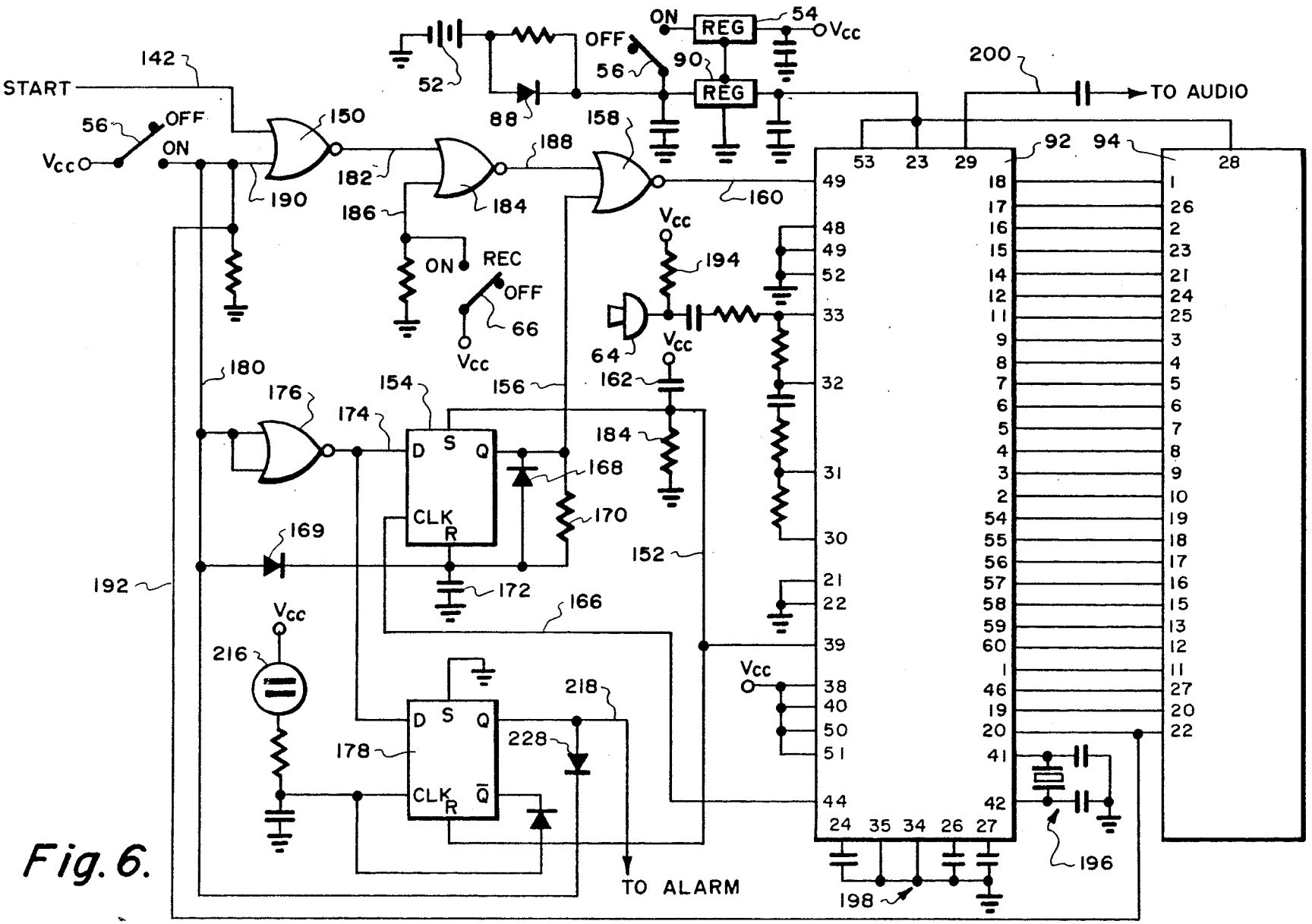

The circuitry shown in FIGS. 5, 6 and 7 could be utilized not only within the director 10 but also within the second embodiment 72 with the only difference being that some portion of the circuitry will not be utilized within the director 10 that will be utilized within the embodiment 72. The embodiment 72 comprises an elongated post 74 which is mounted on a base 76. The upper end of the post 74 includes a strobe light assembly 78. The strobe light assembly 78 includes a mechanism that causes a light to rotate. Such as strobe light assembly 78 is deemed to be conventional and forms no specific part of this invention and is merely to be substituted for the pair of lights 36 and 38. Mounted on the post 74 would be a selector switch 40 which is to be movable to either a strobe only position or movable to a strobe and voice position. Also mounted within the post 74 is a sensor 34 with a similar sensor 80 mounted on the opposite wall surface of the post 74. The purpose of the sensor 34 is to detect movement approximately one hundred eighty degrees in the forward direction from the post 74 while the senor 80 is to detect movement one hundred eighty degrees in the rearward direction of the post 74. Each of the sensors 34 and 80 have their own separate electronic circuitry which will be described further on in this specification.

Also mounted on the post 74, adjacent the sensor 34, is a microphone 64 and a record button 66, as well as the low battery indicator light 68 and the charging jack 70 which again are not shown within the schematic of FIGS. 5, 6 and 7. On another wall of the post 74 is to be mounted the key lock 56.

It is to be noted that the post 74 also includes a pair of hooks 82 and 84. It is these hooks 82 and 84 which facilitate connection with chains (not shown) which are to connect together directly adjacent embodiemnts 72 to form a barrier. When forming the barrier, it is desired to warn a human being to not pass a certain point. In this particular instance only the sensor 34 may be required to be activated if the three hundred sixty degree warning is not necessary. The selection of either the one hundred eighty degree or the three hundred and sixty degree position is accomplished by selector switch 86. Selector switch 86 is also mounted on the post 74.

When the switch 56 is in the "off" position, a small amount of electrical current from the battery is conducted through diode 88, voltage regulator 90 to pin 23 of a computer chip 92. The computer chip 92 is deemed to be conventional and constitutes a purchaseable product of OKI Semiconductor Corp. of Sunnyvale, California, Part Number MSM6309. The purpose of the continuous current being supplied through the regulator 90 is so that the memory within the chip 92 is maintained even with the switch 56 is the "off" position. This current is supplied from the chip 92 to a random access memory chip 94. The amount of data that the chip 94 can contain can be selected according to individual needs. A typical chip 94 would be that manufactured by Motorola and carry Part Number MC16264. Chip 92 includes a timing circuit 196 and a filter circuit 198 which are deemed to be conventional.

With the switch 56 in the "on" position, the output voltage Vcc of regulator 54 is transmitted to line 96. The sensor 34, which is in the form of an infrared sensor, is now being supplied an input voltage. The sensor 34 is part of its own sensor circuit 98.

This sensor circuit 98 includes a filter in the form of a capacitor 100 and a resistor 102. Once the sensor 34 detects movement, an output voltage is generated and transmitted to amplifier 104. Sensor circuit 98 includes a resistor 103 located between the sensor 34 and the amplifier 104. Resistor 103 is connected to ground. Associated with the amplifier 104 is a typical arrangement utilizing capacitor 106, resistor 108, a second resistor 110 and a second capacitor 112. The output of the amplifier 104 goes high and charges capacitor 114. The output of capacitor 114 is transmitted through resistor 116 into a second amplifier circuit utilizing amplifier 118, capacitor 120 and resistor 122. The output of the amplifier 118 is now being transmitted to two separate amplifiers 124 and 126. The two amplifiers 124 and 126 are connected together in a manner to form a comparator. As part of the comparator circuit there is utilized resistors 128, 130, 132, 134 and 136. The output from the amplifier 118 is connected through capacitor 138 prior to being conducted to the amplifier 124. The output sides of the amplifiers 118 and 124 are connected together by conducor 140.

The input voltage is connected to a start line 142 through resistor 144. The start line 142 is also connected to the output lines 146 and 148 of the amplifiers 126 and 124, respectively. Start line 142 is also connected to the selector switch 86.

Once the infrared sensor 34 detects movement, a voltage is transmitted to and amplified by amplifiers 104 and 118 and prior to being transmitted to amplifiers 124 and 126. The voltage within line 142 is normally around 2.75 volts. When motion is detected, either the voltage within line 142 increase or decreases. If the voltage goes above 3.5 volts or below 2.5 volts, there is a low signal being transmitted to NOR gate 150.

If the selector switch 86 is moved to the three hundred sixty degree position, the infrared sensor 80 and its associated circuit 152 is activated. Sensor 34 remains in an activated state. The circuit 152 is essentially identical to circuit 98 and like numerals have been utilized to refer to like parts. Therefore, for the discussion of the operation of the circuit 152, reference is to be had to the circuit 98.

It is to be understood that with the selector switch 86 in the three hundred degree position that either sensor 34 or 80 will result in the transmission of the low signal into line 142 to the NOR gate 150.

When the switch 56 is moved to the "on" position, there is a tendency for the device of this invention to cause a recorded message to be played by the speaker 28. In order for this to be avoided, a signal is transmitted from pin 39 through conductor 152 to flip-flop 154. The high output of the flip-flop 154 is transmitted from the Q pin through conductor 156 to NOR gate 158. As a result, the output of conductor 160 of the NOR gate 158 is caused to be low with no activation of any message. Pin 47 of the chip 92 must receive a high signal to play a message.

Connected to the line 152 is a setting circuit in the form of capacitor 162 and resistor 164. It is to be noted that capacitor 162 is connected to voltage Vcc. When the chip 92 is activated, there is triggered through conductor 166 a ten second delay of flip-flop 154. When the output of the Q pin is high, the NOR gate 158 is disabled. This is changed when the resetting circuits 162 and 164 resets the flip-flop 154. Associated with the flip-flop 154 is a diode 168, resistor 170 and capacitor 172. It is the function of this circuitry to cause a slow change and when the voltage is 3 volts, the flip-flop 154 is to be reset with the output in line 156 going low. Now if a low signal is asserted in line 188, the NOR gate 158 will produce a high output in line 160. One of the primary functions of the flip-flop 154 is to prevent a message to be quickly repeated as motion is detected by either sensor 34 or 80. For this reason, there is a ten second delay between messages.

Pin D of the flip-flop 154 is connected by output line 174 of the NOR gate 176. The line 174 is also connected to the D pin of a second flip-flop 178.

The input to the NOR gate 176 is supplied through line 180. Line 180 goes high when switch 56 is closed. This high signal is transmitted to NOR gate 150 and NOR gate 176. As a result, the output of both NOR gates 150 and 176 is low. Prior to closing of switch 66, the outut of NOR gate 184 IS high in line 188 and transmitted to NOR gate 158 insuring that output of such is low and no message will be played. When switch 66 is closed, output on NOR gate 184 in line 188 goes high which results in a low signal in line 160. There is a low signal in line 156. The output of NOR gate 158 is high in line 160 activating pin 47 of chip 92. When switch 56 was closed, a high signal was received by pin 20 of chip 92. Activating of both pins 47 and 20 places the chip 92 in position to receive and record a message. After dictation of message, the operator releases switch 66 which resets the chip 92 in position to play a message. During the entire time the message is dictated, the buttom 66 is held in the "on" position. After the message has been dictated and button 66 released, the operator moves switch 56 from the record position to the open position. The sensor 34 will detect the presence of the operator and cause the message to be played so the operator can approve the message.

The operator dictates the message into the microphone 64. Microphone 64 supplied by the input voltage Vcc through resistor 194. Microphone 64 is also connected through appropriate series of capacitory and resistors for filtering reasons to pins 30, 31, 32 and 33 of the chip 92.

When the operator proceeds to initiate recording, the sensor 34 (or 80) will sense the operator and being to play the message. However, once switch 56 is closed, no message will result. But, the time delay of flip-flop 154 will be initiated. This means that the operator would normally have to wait the ten seconds until initiating recording. To avoid this waiting, diode 169 is placed between line 180 and pin R of flip-flop 154 which voids this time delay.

Let it be assumed that motion has been detected by either or both the sensors 34 and/or 80. The output line 200 goes high and is transmitted through a filter which includes amplifier 202 and a series of capacitors, resistors and inverters to produce a signal within output line 204. This signal is conducted through resistor 206, capacitor 208, to amplifier 210. It is understood that both amplifiers 202 and 210 receive input voltage Vcc. The output of amplifier 210 is transmitted through capacitor 212, through transistor 214 to speaker 28. Transmission through transistor 214 will occur only when the select switch 40 is in the voice transmission position. If switch 40 happens to be in the "light only" position, there will not be any output of the speaker 28.

There is also incorporated an ANTI-THEFT or TILT ALARM which utilizes a mercury switch 216. Switch 216 is supplied input circuitry Vcc. This switch 216 is normally open with no signal being transmitted to pin $\overline{Q}$ of flip-flop 178. If either the director 10 or the warning device 72 is picked up or moved while operating, or is tipped over, switch 216 will close. This will produce a high output signal from pin Q of flip-flop 178 within line 218. A high signal within line 218 closes transistor 220 which permits the conducting of voltage Vcc in the line 222. Signal within line 222 operates the amplifier 224 and its associated circuitry to produce a square wave signal within line 226. Line 226 is connected through amplifier 210 which results in emitting a siren-like noise from the speaker 28.

The alarm output from pin Q of flip-flop 178 is conducted through one directional diode 228 to produce a high signal to both the inputs of NOR gate 176 and NOR gate 150. The net result is that there will be no output produced within line 160 to pin 47 of chip 92 and therefore no message will be played during the alarm mode. The high signal within line 180 also disables the ability to record during the time the alarm is being activated. When the alarm output within line 222 is high, such is conducted through line 230 to close transistor 214. If perchance selector switch 40 is in the light only mode, the closing of the transistor 214 will ensure that the noisy alarm signal will be emitted by the speaker 28.

What is claimed is:

1. A portable warning device comprising:

a stanchion having an upper end and a lower end, said lower end adapted to be located on a supportive surface, said upper end being spaced from the supportive surface, said stanchion having a plurality of side walls each, said side wall being planar with the arrangement of said side walls being polygonal;

light means located at said upper end, said light means being readily visually observable by a human being when coming into close proximity with said stanchion;

antitheft alarm means connected to said stanchion, said antitheft alarm means to activate an annunciator upon said stanchion being moved from its established location;

human voice recording means connected to said stanchion, said recording means being activatable to record a particular message;

sensor means connected to said stanchion, said sensor means being activated upon a human being moving within a certain distance of said stanchion, said sensor means being wireless and detecting heat of the human being, said sensor means comprising a pair of sensor, switch means associated with said stanchion, said switch means for selecting either one said sensor or both said sensors, one said sensor being mounted within one said side wall, the remaining said sensor being mounted within another said side wall, said sensors functioning to be sensitive to the entire three hundred sixty degree arear directly about said stachion; and sound reproduction means connected to said stanchion, said message being reproduced and transmitted upon activation of said sensor means.

2. The portable warning device as defined in claim 1, wherein:

said light means being movable during activation.

3. The portable warning device as defined in claim 2 wherein:

said light means comprising a strobe.

4. The portable warning device as defined in claim 1 wherein:

said annunciator comprising a sound emitting device.

5. The portable warning device as defined in claim 1 wherein:

said polygonal arrangement comprising a square, said sensors being mounted within opposing said side walls.

* * * * *